428-408 SR
8/31/82 XR 4,347,279

United States Patent [19]
Saji et al.
[11] 4,347,279
[45] Aug. 31, 1982

[54] HIGH PERFORMANCE CARBON FIBER, PROCESS FOR PRODUCTION THEREOF, AND COMPOSITE MATERIALS PREPARED THEREWITH

[75] Inventors: Yasuo Saji, Mishima; Kozo Tanaka, Numazushi; Takashi Yamauchi, Shizuoka, all of Japan

[73] Assignee: Toho Beslon Co., Ltd., Tokyo, Japan

[21] Appl. No.: 294,866

[22] Filed: Aug. 21, 1981

[30] Foreign Application Priority Data

Aug. 22, 1980 [JP] Japan ..... 55-114764

[51] Int. Cl.[3] ..... B32B 31/18

[52] U.S. Cl. ..... 428/294; 264/29.2; 264/29.7; 423/447.6; 428/367; 428/401; 428/408; 428/902

[58] Field of Search ..... 428/294, 367, 401, 408, 428/902; 264/29.2, 29.7; 423/447.1, 447.2, 447.4, 447.6, 447.7; 252/421, 438

[56] References Cited

U.S. PATENT DOCUMENTS 4,100,004 7/1978 Moss ..... 264/29.2

*Primary Examiner*—Marion McCamish
*Attorney, Agent, or Firm*—Sughrue, Mion, Zinn, Macpeak & Seas

[57] ABSTRACT

A carbon fiber, a process for production thereof, and composite materials prepared therewith are described, wherein the carbon fiber has a single yarn diameter of from 2 to 6 microns and showing a strand knot strength of 7 kilograms or more when formed into a strand of 0.4±0.01 gram per meter, which comprises subjecting a 0.1 to 0.6 denier acrylonitrile-based fiber having a strength of 6 grams per denier or more to a preoxidation treatment wherein the acrylonitrile-based fiber is treated under such tension as to provide a shrinkage of at least 3% until the equilibrium water content reaches 5%, and (b) a second preoxidation treatment wherein the acrylonitrile-based fiber is treated under such tension as to provide a shrinkage of at least 1%, said preoxidation treatment is conducted in an oxidizing atmosphere having a temperature of from 240° C. to 300° C. while maintaining the relation between the preoxidation treatment time (t) (minutes) and average preoxidation treatment temperature (T) (°C.) satisfying the equation (1):

$$(310-T)\times(0.8\sim3)=t \qquad (I)$$

and subjecting the thus preoxidized fiber to a carbonization treatment in an inert gas maintained at from 1,000° C. to 1,800° C.

13 Claims, 1 Drawing Figure

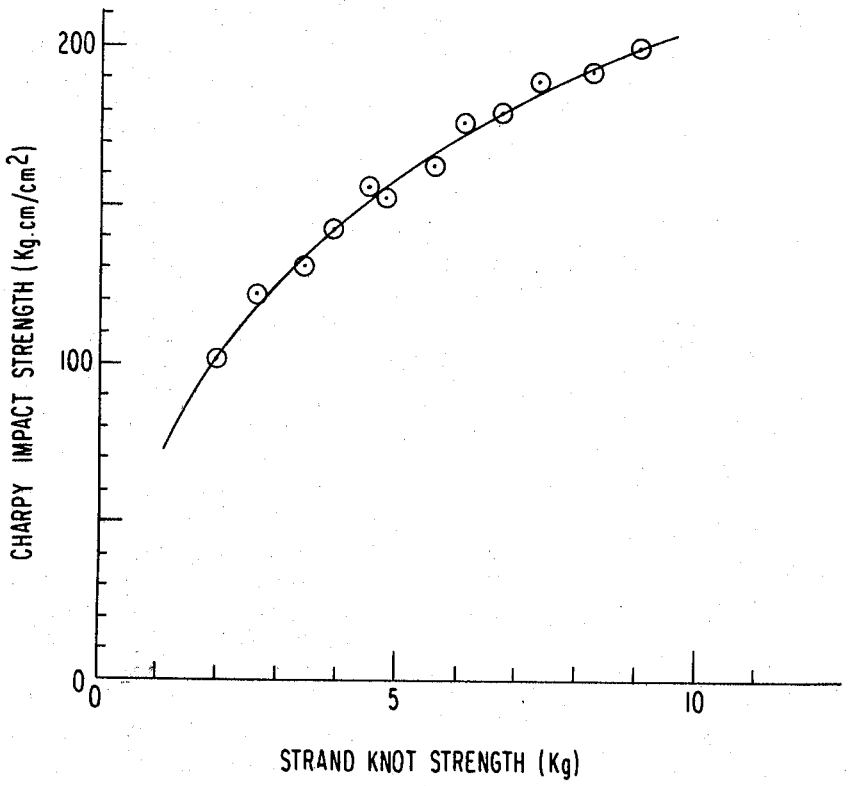
200
100
0
0
5
10
CHARPY IMPACT STRENGTH (Kg.cm/cm²)
STRAND KNOT STRENGTH (Kg)

HIGH PERFORMANCE CARBON FIBER, PROCESS FOR PRODUCTION THEREOF, AND COMPOSITE MATERIALS PREPARED THEREWITH

FIELD OF THE INVENTION

The present invention relates to a process for the production of superfine carbon fibers which are greately improved in the strand knot strength, and which, when formed into a composite material, show excellent impact strength.

BACKGROUND OF THE INVENTION

A number of methods have heretofore been proposed for the production of carbon fibers from acrylonitrile-based fibers. These methods have been developed for various purposes, for example, improvements in the chemical and physical properties of carbon fibers and rationalization (improving efficiency) of production steps. With regard to the improvements in the physical properties, many of the proposed methods are directed to improvements in the tensile strength and tensile modulus of carbon fibers. In many cases, carbon fibers are in practical use as composite materials in combination with resins such as an epoxy resin. Composite materials prepared using conventional carbon fibers, however, are inferior in impact strength, although they are excellent in the tensile and flexural strengths.

SUMMARY OF THE INVENTION

An object of the invention is to provide carbon fibers having a high strand knot strength and a process for the production of said carbon fibers.

Another object of the invention is to provide carbon fibers which can be used as reinforcing fibers for the preparation of composite materials having a high impact strength, and a process for the production of said carbon fibers.

A further object of the invention is to provide carbon fiber-reinforced composite materials having a high impact strength.

The present invention, therefore, relates to a process for producing carbon fibers having a single yarn diameter of from 2 to 6 microns and showing a strand knot strength of at least 7 kilograms when formed into a strand of 0.4±0.01 gram per meter (g/m), which process comprises: subjecting a 0.1 to 0.6 denier acrylonitrile-based fiber having a tensile strength of at least 6 grams per denier (g/d) to a preoxidation treatment consisting of (a) a first preoxidation treatment wherein the acrylonitrile-based fiber is treated under such tension as to provide a shrinkage of at least 3% until the equilibrium water content reaches 5%, and (b) a second preoxidation treatment wherein the acrylonitrile-based fiber is treated under such tension as to provide a shrinkage of at least 1%, said preoxidation treatment is conducted in an oxidizing atmosphere having a temperature of from 240° C. to 300° C. while maintaining the relation between the preoxidation treatment time (t) (minutes) and average preoxidation treatment temperature (T) (°C.) satisfying the equation (I):

$$(310-T)\times(0.8\sim3)=t \qquad \text{(I)}$$

subjecting the thus-preoxidized fiber to a carbonization treatment in an inert gas maintained at from 1,000° C. to 1,800° C. (0.8∼3 means a number within the range of from 0.8 to 3).

The process of the invention enables the production superfine carbon fibers in high productivity which have a high strand knot strength and can be used as reinforcing fibers to provide a composite material having an excellent impact strength.

BRIEF DESCRIPTION OF THE DRAWINGS

The FIGURE is a graph showing the relation between the strand knot strength of carbon fibers and the Sharpy impact strength of a composite material prepared using the carbon fibers.

DETAILED DESCRIPTION OF THE INVENTION

The technical terms as used herein are defined as follows:

Average Preoxidation Treatment Temperature (T) (°C.)

In shortening the preoxidation treatment time and improving the quality of carbon fibers, it is effective to perform the preoxidation treatment in multiple stages while gradually raising the temperature rather than performing it at a constant temperature.

When the preoxidation treatment is performed in multiple steps "n" for $t_1$ minutes at $T_1$ °C., for $t_2$ minutes at $T_2$ °C., . . . , and for $t_n$ minutes at $T_n$ °C., the average preoxidation treatment temperature (T) (°C.) is defined as follows:

$$T=\frac{(T_1\times t_1)+(T_2\times t_2)+\ldots(T_n t_n)}{t_1+t_2+\ldots t_n} \qquad \text{(II)}$$

n is 2 or more, and generally, 3 to 4, and it may be more than 4, although no industrial benefit is obtained by using more than 4 steps.

Shrinkage

When the original length is l and the length after shrinkage is l', the shrinkage is defined as follows:

$$\text{Shrinkage}=\frac{l-l'}{l}\times 100(\%)$$

Equilibrium Water Content

The equilibrium water content of fibers in the course of the preoxidation treatment is determined by the following method.

About 1 gram of absolutely dried preoxidized fibers are placed in a desiccator (temperature: 20° to 30° C.; relative humidity: 80%) containing an aqueous ammonium chloride solution in which a solid phase co-exists, and are allowed to absorb moisture for 24 hours. Thereafter, the amount of water absorbed is measured, and the ratio of the absorbed water to the absolutely dried preoxidized fiber is calculated and is referred to as the water content.

Strand Knot Strength

Carbon fiber strands are bundled or divided so that the weight per meter be 0.4±0.01 gram. For example, in the case of a strand having a weight per meter of 0.2 gram, two strands are placed in parallel to prepare a sample. In the case of a strand having a weight per meter of 1 gram, it is divided carefully so that the weight per meter be 0.4±0.01 gram. In this case, it is necessary to divide the strand while minimizing the deterioration of monofilaments. Then, knots are provided onto a strand of 0.4±0.01 gram per meter in the same manner as in measuring the knot strength of monofilament.

The knotted strand is mounted onto an Instron type tensile testor in such a manner that the chuck distance is 100 milimeters and the knot portion is located in nearly the center thereof. The breaking strength is measured at a tensile speed of 50 milimeters per minute and is referred to as "stand knot strength".

Impact Strength

The impact strength is measured according to JIS K 7111 "Sharpy Impact Strength of Cured Plastics". In this case, a phenol novolak type epoxy resin is used as a matrix, and the fiber volume percent is adjusted to 60±2%. The test is performed by application of an edgewise without notch.

Diameter of Single Yarn

Since the cross-section of the carbon fiber is usually not completely circular, the cross-sectional area is measured by means of a microscope, and the diameter of a circle having the same cross-sectional area is calculated and is referred to as "diameter of single yarn".

The inventors' investigations have revealed that the impact strength of a composite material is not always directly associated with the tensile strength, tensile modulus, breaking elongation, and so on of the carbon fiber used. Astonishingly, it has been found that when two composite materials are prepared using carbon fibers having the same tensile modulus the, composite material prepared using carbon fiber having a higher tensile strength has a lower impact strength than the other composite material (see Table 1). As a result of extensive investigations, it has been found that the strand knot strength of carbon fiber is a effective and correct measure for the impact strength of a composite material, as illustrated in the drawing.

TABLE 1

| Characteristics of Carbon Fiber Strand | | | |
|---|---|---|---|
| Tensile Strength ($kg/mm^2$) | Tensile Modulus ($kg/mm^2$) | Knot Strength (kg) | Impact Strength of Composite Material ($kg.cm/cm^2$) |
| 361 | 24,000 | 3 | 120 |
| 342 | 24,000 | 3.5 | 131 |
| 331 | 24,000 | 4.5 | 148 |
| 380 | 24,000 | 8.5 | 195 |
| 381 | 24,000 | 8.0 | 190 |
| 340 | 24,000 | 7.1 | 182 |

Based on the foregoing findings, it has been discovered that carbon fiber strands having a single yarn diameter falling within a specific range and showing a strand knot strength exceeding a specific value provide high impact resistance to composite materials. That is, when carbon fibers having a single yarn diameter of from 2 to 6 microns and showing a strand knot strength of at least 7 kilograms when formed into a strand of 0.4±0.01 gram per meter are used as reinforcing materials, the impact resistance of the resulting composite material can be greatly increased.

The invention will be hereinafter explained in greater detail.

The characteristics of the carbon fiber depend greatly on the characteristics of acrylonitrile-based fiber used as a starting material. The acrylonitrile-based fiber as used herein means a fiber made of an acrylonitrile homopolymer or a copolymer containing 95% by weight or more of acrylonitrile. Preferable examples of comonomers which can be used in producing such acrylonitrile copolymers include vinyl esters, e.g., vinyl acetate, acrylates, methacrylates, vinyl ethers, acrylic acid, methacrylic acid, itaconic acid, metal (Na, K, Ca, Zn, etc.) salts of such acids, acid chlorides of such acids, acid amides of such acids, n-substituted derivatives of vinyl amides of such acids (examples of such derivatives are N-methylolacrylamide, N,N'-dimethylacrylamide, N,N'-diethylacrylamide, sodium salt of methylsulfonic acid acrylamide and sodium salt of ethylsulfonic acid acrylamide) vinyl chloride, vinylidene chloride, α-chloroacrylonitrile, vinyl pyridines, vinylbenzenesulfonic acid, vinylsulfonic acid, and alkaline or alkaline earth metal salts thereof.

In order to make the desired carbon fiber, it is necessary to use a 0.1 to 0.6 denier, and preferably a 0.3 to 0.5 denier, acrylonitrile-based fiber having a tensile strength of at least 6 grams per denier, and preferably at least 6.2 grams per denier. Such carbon fibers can be produced by known methods, for example, a method as described in Japanese Patent Publication No. 43616/1979. This method can provide carbon fibers having a strength of 6.2 grams per denier or more.

In order to provide a high strand knot strength, it is important to control the formation of coalescence as well as to maintain the degree of orientation and degree of densification at suitable levels. In the method of the invention, therefore, it is necessary to use fibers which are specified in terms of strength and denier. Using fibers other than the specific fibers, it is not possible to obtain carbon fiber strands having a single yarn diameter of from 2 to 6 microns and a strand knot strength of at least 7 kilograms.

The conditions under which the preoxidation treatment is performed are important in the method of the invention. It is natural from an industrial viewpoint that an increase in performance and an improvement in productivity should be taken into consideration. In order preoxidize the specified acrylonitrile-based fiber in as short a period as possible while holding its characteristics, it is necessary to apply the preoxidation treatment under the conditions specified in the invention.

It is known that as the denier of the starting yarn is small, it becomes more difficult for the two-phase cross-section structure to occur when the preoxidation treatment is applied under specified conditions, and that this exerts good influences on the performance of the carbon fiber. In accordance with the method of the invention, high performance and superfine carbon fibers can be produced in a short period of time at a high productivity by employing acrylonitrile-based fibers having the specific tensile strength and denier, and balancing among the temperature, time and shrinkage.

The preoxidation treatment in the method of the invention is performed in an oxidizing atmosphere, e.g., air, maintained at a temperature of 240° to 300° C., and it is necessary that the preoxidation treatment time (t) and the preoxidation treatment temperature (T) satisfy the following equation:

$$(310-T)\times(0.8\sim3)=t \qquad \text{(I)}$$

where T is an average preoxidation treatment temperature (°C.) and t is a preoxidation treatment time (minutes).

This equation is explained by reference to the conditions of Example 1.

$$T = \frac{(263 \times 30) + (270 \times 25) + (290 \times 4)}{30 + 25 + 4} = 267.8$$

Accordingly, T is 267.8.

Therefore, the equation (I) is as follows:

$$(310-267.8)\times(0.8\sim3)=33.8 \text{ to } 126.6$$

In Example 1, $t_1+t_2+t_3=30+25+4=59$. Thus, the preoxidation treatment temperature and treatment time satisfy the equation (I). That is, it can be seen that when the preoxidation treatment temperature and treatment time satisfy the equation (I), the objects of the invention can be attained.

Where the starting yarn of the invention, particularly a low denier of starting yarn having a high tensile strength and a high orientation structure, is subjected to a preoxidation treatment, it is greatly effective in preventing the end breakage of yarn and the formation of fluff that the shrinkage be controlled to at least 3%, and preferably from 4 to 10% during the first preoxidation treatment wherein the equilibrium water content is increased to 5%. When the shrinkage is less than 3%, or a stretching treatment is applied, the formation of fluff is significant and the coalescence is liable to occur, and therefore carbon fiber having the desired strand knot strength cannot be obtained. Although the shrinkage can be increased up to 20%, if it is increased up to more than 20%, carbon fiber having an excellent tensile strength and strand knot of at least 7 kg can not be obtained. It is also necessary to provide a shrinkage of at least 1%, and preferably from 2% to 8% in the second preoxidation treatment. At this stage, the shrinkage can be increased up to about 20%. However, if it is increased up to more than 20%, carbon fiber having an excellent tensile strength and strand knot of at least 7 kg can not be obtained. It is only when the characteristics of the starting yarn and the preoxidation treatment conditions are controlled within the ranges as defined herein that the desired carbon fiber can be produced effectively. When the second preoxidation treatment is further divided into the first half and second half steps, and the preoxidation treatment is applied while providing a predetermined shrinkage at the first half step and a finishing treatment is applied for about 30 seconds to about 20 minutes at a constant length of fiber at the second half step, preferred results can be obtained.

The total shrinkage is usually from 4% to 30%, and preferably from 6% to 20%, during all the preoxidation treatment steps.

Although the equilibrium water content can be increased up to about 13% by the preoxidation treatment, it is not necessary to proceed the preoxidation treatment until the maximum equilibrium water content is obtained. The equilibrium water content is usually from about 9% to 12%.

Thereafter, the carbonization treatment is applied. (In the practice of the invention, the equilibrium water content and shrinkage are sufficient to be such that the rounded off values are within the ranges defined herein).

The carbonization treatment is performed by a conventional procedure in an atmosphere of an inert gas, such as nitrogen and argon, at from 1,000° C. to 1,800° C. while preventing the introduction of oxidizing gases.

In the method of the invention, in particular, at the preoxidation treatment step, if any one of the temperature, time, and shrinkage is not within the ranges defined herein, the objects of the invention can not be attained. The thus-obtained superfine carbon fiber has a single yarn diameter of from 2 to 6 microns and a strand knot strength of at least 7 kilograms.

Composite materials reinforced with the carbon fibers as produced above exhibit excellent impact strength. Resins which can be used as a matrix of such composite materials include thermosetting resins such as a furan resin, a phenol resin, a polyimide resin, and an epoxy resin, and thermoplastic resins such as polyolefin, nylon, polyvinyl chloride, polyvinylidene chloride, and polyester. The carbon fiber is impregnated with such matrix resins in liquid form and solified or cured. After the impregnation of the carbon fiber with the thermosetting resin in liquid form, it may be cured by application of heat and pressure, and then can be carbonized whereby a carbon fiber-reinforced composite material containing carbon as a matrix can be obtained. The volume of fiber in the composite material is usually from 20% to 80%, and more preferably from 30% to 60%, by volume, although it can be varied appropriately depending on the particular purpose for which it is to be used.

The invention is explained in greater detail by reference to the following examples.

EXAMPLE 1

An acrylonitrile-based fiber strand made of a copolymer comprising 96% by weight of acrylonitrile and 4% by weight of methyl acrylate, having a tensile strength of 6.8 g/d and an average denier of 0.50 d, and composed of 6,000 filaments was used. As the first preoxidation treatment, the acrylonitrile-based fiber was treated in air maintained at 263° C. for 30 minutes so that the shrinkage was 8%, and a fiber having an equilibrium water content of 5.0% was obtained. As the first half step of the second preoxidation treatment, the fiber was subjected to a preoxidation treatment at 270° C. for 25 minutes at a shrinkage of 5%, and furthermore, as the second half step of the second preoxidation treatment, the fiber was subjected to a preoxidation treatment at 290° C. for 4 minutes while maintaining the length at a constant level.

The thus-obtained fiber was subjected to a carbonization treatment at a temperature of 1,300° C. in an atmosphere of nitrogen gas for 3 minutes.

The thus obtained carbon fiber had a single yarn diameter of 5.3 microns, a strand knot strength of 8.6 kilograms, a tensile strength of 390 kg/mm$^2$ and a tensile modulus of 24,000 kg/mm$^2$.

Using the carbon fiber as obtained above, a composite material was produced (in the same manner as shown in above-described JIS K7111) in combination with a phenol resin. The composite material had a Sharpy impact strength of 196 kg,cm/cm$^2$.

EXAMPLE 2

An acrylonitrile-based fiber strand made of a copolymer comprising 95% by weight of acrylonitrile and 5% by weight of acrylic acid, having a tensile strength of 7.1 g/d and an average denier of 0.2 d, and composed of 1,000 filaments was used. The acrylonitrile strand was treated at 270° C. for 25 minutes at a shrinkage of 8.7% to provide a fiber having an equilibrium water content of 4.9%. The strand was then treated in air under the conditions of a temperature of 275° C., a period of 15 minutes, and a shrinkage of 4.9%, and then was treated in air at a temperature of 290° C., a period of 2 minutes, and a constant length.

The thus obtained fiber was subjected to a carbonization treatment at a temperature of 1,300° C. for 3 minutes in an atmosphere of nitrogen gas.

The thus obtained carbon fiber had a single yarn diameter of 2.3 microns, a strand knot strength of 9.4 kilograms, a tensile strength of 429 kg/mm$^2$ and a tensile modulus of 24,000 kg/mm$^2$. A composite material produced (in the same manner as shown in above-described JIS K7111) using the carbon fiber showed a Sharpy impact strength of 210 kg.cm/cm$^2$.

EXAMPLE 3

Acrylonitrile-based fibers made of the same copolymer as used in Example 1 and having varying deniers and tensile strengths were subjected to the same preoxidation and carbonization treatments as used in Example 1. Using the thus produced carbon fibers, composite materials were produced. For the carbon fibers and composite materials, the single yarn diameter, strand knot strength, and impact strength were measured. The results are shown in Table 2 along with those results obtained in comparative examples.

TABLE 2

| | Acrylonitrile-based Fiber | | Carbon Fiber | | Composite Material |
|---|---|---|---|---|---|
| Run No. | Denier (d) | Tensile Strength (g/d) | Single Yarn Diameter (microns) | Strand Knot Strength (kg) | Impact Strength (kg.cm/cm$^2$) |
| 1 | 0.33 | 6.8 | 4.2 | 8.4 | 184 |
| 2 | 0.35 | 7.4 | 4.3 | 8.6 | 195 |
| 3 | 0.34 | 6.9 | 4.3 | 8.8 | 190 |
| 4 | 0.51 | 7.8 | 5.2 | 9.0 | 200 |
| 5 | 0.50 | 7.0 | 5.1 | 7.9 | 185 |
| 6 | 0.49 | 6.9 | 5.1 | 8.7 | 192 |
| 7 | 0.88 | 6.8 | 6.8 | 5.5 | 158 |
| 8 | 0.91 | 6.9 | 6.9 | 6.0 | 168 |
| 9 | 0.90 | 7.2 | 6.9 | 5.7 | 163 |
| 10 | 1.48 | 6.7 | 8.9 | 4.6 | 155 |
| 11 | 1.50 | 7.5 | 9.0 | 4.5 | 150 |
| 12 | 1.49 | 6.8 | 8.9 | 4.5 | 145 |
| 13 | 0.50 | 5.4 | 5.1 | 5.2 | 160 |
| 14 | 0.49 | 4.8 | 5.1 | 6.0 | 167 |
| 15 | 0.51 | 5.7 | 5.2 | 5.5 | 160 |

Run Nos. 1 to 6: Examples of the invention
Run Nos. 7 to 15: Comparative examples It can be seen from the results shown in Table 2 that when the carbon fibers produced by the method of the invention are used as reinforcing fibers, composite materials having excellent impact strength can be obtained.

EXAMPLE 4

The same acrylonitrile-based fiber strand as used in Example 1 (average denier: 0.50 d; number of filaments: 6,000) was subjected to the preoxidation treatment under varying conditions and subsequently, was subjected to a carbonization treatment as follows: temperature: 1,370° C.; atmosphere: nitrogen gas; time: 3 minutes.

With the thus obtained carbon fibers, the strand knot strength was measured, and the results are shown in Table 3.

TABLE 3

| Preoxidation Treatment Conditions | Invention No. 1 | Invention No. 2 | Comparative Examples No. 3 | No. 4 | No. 5 |
|---|---|---|---|---|---|
| First Preoxidation Treatment | | | | | |
| Temperature (°C.) | 263 | 263 | 263 | 263 | 263 |
| Time (minutes) | 30 | 30 | 30 | 30 | 30 |
| Shrinkage (%) | 8 | 5 | (2.8) | (2) | 3 |
| Equilibrium Water Content (%) | 4.8 | 4.7 | 4.8 | 4.6 | 4.7 |
| Second Preoxidation Treatment | | | | | |
| First Half Step | | | | | |
| Temperature (°C.) | 270 | 270 | 270 | 270 | 270 |
| Time (minutes) | 25 | 25 | 25 | 25 | 25 |
| Shrinkage (%) | 5 | 5 | 5 | 5 | (0.5) |
| Second Half Step | | | | | |
| Temperature (°C.) | 290 | 290 | 290 | 290 | 290 |
| Time (minutes) | 4 | 4 | 4 | 4 | 4 |
| Shrinkage (%) | 0 | 0 | 0 | 0 | 0 |
| Equilibrium Water Content (%) | 10.4 | 10.4 | 10.4 | 10.4 | 10.4 |
| Strand Knot Strength (kg) | 8.5 | 8.7 | 6.3 | — | — |

(1) The values in the parentheses indicate that the conditions of the invention are not satisfied.
(2) In Nos. 4 and 5, the strand was cut during the preoxidation treatment.
(3) In No. 3, the strand was subjected to the formation of fluff.

EXAMPLE 5

An acrylonitrile-based fiber strand made of a copolymer comprising 97% by weight of acrylonitrile and 3% by weight of vinyl acetate, having an average denier of 0.45 d, and composed of 12,000 filaments was used. The acrylonitrile-based fiber strand was subjected to a preoxidation treatment under varying conditions and then to a carbonization treatment at 1,370° C. in an atmosphere of nitrogen gas for 1.5 minutes. For the thus produced carbon fibers, the strand knot strength was measured. The results are shown in Table 4.

TABLE 4

| Preoxidation Treatment | Example 6 | Comparative Example (1) | (2) |
|---|---|---|---|
| First Preoxidation Treatment | | | |
| Temperature (°C.) | 263 | 270 | 255 |
| Time (minutes) | 30 | 12 | 75 |
| Shrinkage (%) | 8 | 8 | 8 |
| Equilibrium Water Content (%) | 4.8 | (2.9) | (6.9) |
| Second Preoxidation Treatment | | | |
| First Half Step | | | |
| Temperature (°C.) | 270 | 290 | 265 |
| Time (minutes) | 25 | 10 | 75 |
| Shrinkage (%) | 5 | 5 | 5 |
| Second Half Treatment | | | |
| Temperature (°C.) | 290 | — | 270 |
| Time (minutes) | 4 | — | 4 |
| Shrinkage (%) | 0 | — | 0 |
| Equilibrium Water Content (%) | 10.6 | 10.7 | 10.1 |

TABLE 4-continued

| Preoxidation Treatment | Example 6 | Comparative Example (1) | Comparative Example (2) |
|---|---|---|---|
| Strand Knot Strength (kg) | 8.5 | 5.4 | 5.5 |

(1) The values in the parentheses indicate that the condition of the invention are not satisfied.
(2) Comparative Example 1 and 2 do not satisfy the equation (I).
(3) In the carbon fiber of Comparative Example 1, voids were discovered in the fiber.
(4) In the carbon fiber of Comparative Example 2, there were many coalescence in the strand.

It can be seen from the results shown in Tables 3 and 4 that only when the preoxidation treatment conditions defined in the invention are employed do the desired carbon fibers have desirably high strand knot strength.

EXAMPLE 6

Strands produced in Example 1 were placed in parallel to form a layer of 150 g/m$^2$, and impregnated with a bisphenol A type epoxy resin to produce a prepreg in which the fibers were orientated in one direction. 20 sheets of these prepregs were laminated in such a manner that the direction of fiber was disposed in one direction, and cured under a load of 7 kg/cm$^2$ at 150° C. to produce a 3 mm thick composite material in which the volume of fiber was 60% and the fiber was disposed in one direction.

With the thus produced composite material, the Sharpy impact strength was 150 kg.cm/cm$^2$.

On the other hand, using a strand having a single yarn diameter of 7 microns, a strand knot strength of 6.0 kilograms, a tensile strength of 380 kg/mm$^2$ and a tensile modulus of 24,000 kg/mm$^2$, a composite material was produced in the same manner as above. The Sharpy impact strength of the composite material was 120 kg.cm/cm$^2$.

EXAMPLE 7

The strands produced in Example 2 were placed in parallel to form a layer of 150 g/m$^2$ impregnated with a 40% by weight solution of a bismaleimide resin (XLA 4024 produced by Toshiba Chemical Co., Ltd.) in dioxane to produce a prepreg in which the fiber was disposed in one direction. 20 sheets of these prepregs were laminated in such a manner that the fiber was disposed in one direction. A procedure of applying a pressure of 15 kg/cm$^2$ and returning the pressure to atmospheric pressure was repeated five times. Gases generated were released. Thereafter, the pressure was railed to 40 kg/cm$^2$, and the prepregs were held at 210° C. for 40 minutes at that pressure, and then were post-cured 230° C. for 3 hours, to produce a test piece having a thickness of 3 mm and a volume of fiber of 60%. The Sharpy impact strength of the test piece was 320 kg.cm/cm$^2$.

On the other hand, using a strand having a single yarn diameter of 7 microns, a strand knot strength of 5.7 kilograms, a tensile strength of 430 kg/mm$^2$ and a tensile modulus of 24,000 kg/mm$^2$, a test piece was produced in the same manner as above. The impact strength of the test piece was 270 kg.cm/cm$^2$.

While the invention has been described in detail and with reference to specific embodiments thereof, it will be apparent to one skilled in the art that various changes and modifications can be made therein without departing from the spirit and scope thereof.

What is claimed is:

1. A process for producing a carbon fiber having a single yarn diameter of from 2 to 6 microns and showing a strand knot strength of at least 7 kilograms when formed into a strand of 0.4±0.01 gram per meter, said process comprising: subjecting a 0.1 to 0.6 denier acrylonitrile-based fiber having a tensile strength of at least 6 grams per denier to a preoxidation treatment consisting of (a) a first preoxidation treatment wherein the acrylonitrile-based fiber is treated under such tension as to provide a shrinkage of at least 3% until the equilibrium water content reaches 5%, and (b) a second preoxidation treatment wherein the acrylonitrile-based fiber is treated under such tension as to provide a shrinkage of at least 1%, said preoxidation treatment is conducted in an oxidizing atmosphere having a temperature of from 240° C. to 300° C. while maintaining the relation between the preoxidation time (t) (minutes) and average preoxidation treatment temperature (T) (°C.) satisfying the equation (I):

$$(310-T)\times(0.8\sim3)=t \qquad \text{(I)}$$

and subjecting the thus preoxidized fiber to a carbonization treatment in an inert gas maintained at from 1,000° C. to 1,800° C.

2. A process as in claim 1, wherein the preoxidation treatment is performed in a number of stages "n", and when the preoxidation treatment is performed at $T_1$ °C. for $t_1$ minutes, at $T_2$ °C. for $t_2$ minutes, . . . at $T_n$ °C. for $t_n$ minutes, T is determined as follows:

$$T=\frac{(T_1\times t_1)+(T_2\times t_2)+\ldots(T_n\times t_n)}{t_1+t_2+\ldots t_n} \qquad \text{(II)}$$

wherein n is at least 2.

3. A process as in claim 1, wherein the shrinkage during the first preoxidation treatment is from 3% to 20%.

4. A process as in claim 1, wherein the shrinkage at the second preoxidation treatment is from 1% to 20%.

5. A process as claimed in claim 1, wherein the total of the shrinkage at the preoxidation treatment is from 4% to 30%.

6. A process as in claim 1, wherein the second preoxidation treatment is performed until the equilibrium water content reaches from 9% to 12%.

7. A process as claimed in claim 1, wherein the second preoxidation treatment is divided into the first half and the second half steps, and the preoxidation is conducted while providing a predetermined shrinkage at the first half step and a finishing treatment is applied for from 30 seconds to 20 minutes at a constant length of the fiber at the second half step.

8. A carbon fiber having a single yarn diameter of from 2 to 6 microns and showing a strand knot strength of at least 7 kilograms when formed into a strand of 0.4±0.01 gram per meter, which is produced by subjecting a 0.1 to 0.6 denier acrylonitrile-based fiber having a strength of at least 6 grams per denier to a preoxidation treatment consisting of (a) first preoxidation treatment wherein the acrylonitrile-based fiber is treated under such tension as to provide a shrinkage of at least 3% until the equilibrium water content reaches 5%, and (b) a second preoxidation treatment wherein the acrylonitrile based fiber is treated under such tension as to provide a shrinkage of at least 1%, said preoxidation treatment is conducted in an oxidizing atmosphere having a temperature of 240° C. to 3000° C. while maintaining the relation between the preoxidation time (t) (minutes) and average preoxidation treatment temperature (T) (°C.) satisfying the equation (I):

$$(310-T)\times(0.8\sim3)=t \quad \text{(I)}$$

and subjecting the thus preoxidized fiber to a carbonization treatment in an inert gas maintained at from 1,000° C. to 1,800° C.

9. A composite material containing as a reinforcing material a carbon fiber having a single yarn diameter of from 2 to 6 mincrons and showing a strand knot strength of at least 7 kilograms when formed into a stand of 0.4±0.01 gram per meter, which is produced by subjecting a 0.1 to 0.6 denier acrylonitrile-based fiber having a tensile strength of at least 6 grams per denier to a preoxidation treatment consisting of (a) a first preoxidation treatment wherein the acrylonitrile-based fiber is treated under such tension as to provide a shrinkage of at least 3% until the equilibrium water content reaches 5% and (b) a second preoxidation treatment wherein the acrylonitrile-based fiber is treated under such tension as to provide a shrinkage of at least 1%, said preoxidation treatment is conducted in an oxidizing atmosphere having a temperature of from 240° C. to 300° C. while maintaining the relation between the preoxidation treatment time (t) (minutes) and average preoxidation treatment temperature (T) (°C.) satisfying the equation (I):

$$(310-T)\times(0.8\sim3)=t \quad \text{(I)},$$

and subjecting the thus preoxidized fiber to a carbonization treatment in an inert gas maintained at 1,000° to 1,800° C.

10. A composite material as in claim 9, wherein the matrix of the composite material is a thermosetting resin, a thermoplastic resin, or carbon.

11. A composite material as in claim 10 wherein the matrix is a thermosetting resin selected from a furan resin, a phenol resin, a polyimide resin, or an epoxy resin.

12. A composite material as in claim 10 wherein the matrix is a thermoplastic resin selected from polyolefin, nylon, polyvinyl choride, polyvinylidene chloride, or polyester.

13. A composite material as claimed in claim 9, 10, 11, or 12, wherein the carbon fiber content is from 20% to 80% by volume.

* * * * *